US007350857B2

(12) United States Patent
Bishop

(10) Patent No.: US 7,350,857 B2
(45) Date of Patent: Apr. 1, 2008

(54) CASE WITH SEAT

(76) Inventor: Gordon William Bishop, Brook House, Rough Road, Woking, Surrey GU22 0RB (GB)

( * ) Notice: Subject to any disclaimer, the term of this patent is extended or adjusted under 35 U.S.C. 154(b) by 0 days.

(21) Appl. No.: 10/556,872

(22) PCT Filed: May 14, 2004

(86) PCT No.: PCT/GB2004/002085

§ 371 (c)(1),
(2), (4) Date: Nov. 15, 2005

(87) PCT Pub. No.: WO2004/100699

PCT Pub. Date: Nov. 25, 2004

(65) Prior Publication Data

US 2007/0007801 A1 Jan. 11, 2007

(30) Foreign Application Priority Data

May 16, 2003 (GB) ..... 0311256.2

(51) Int. Cl.
*A47C 13/00* (2006.01)
*A47C 4/52* (2006.01)
*A47C 7/62* (2006.01)

(52) U.S. Cl. ..... 297/129; 297/183.2; 297/188.1; 190/8

(58) Field of Classification Search ..... 297/129, 297/183.2, 188.1, 440.1, 188.2, 188.08, 188.09, 297/188.12; 190/8
See application file for complete search history.

(56) References Cited

U.S. PATENT DOCUMENTS 630,427 A * 8/1899 Turner ..... 190/2
2,532,863 A * 12/1950 Taylor ..... 217/14
4,555,827 A * 12/1985 St. Louis ..... 16/34
4,974,870 A * 12/1990 Jarke et al. ..... 280/643
5,310,208 A 5/1994 Jarke
5,622,404 A 4/1997 Menne
5,988,657 A 11/1999 Henkel
6,196,560 B1 3/2001 Ohlsson
6,241,313 B1 6/2001 Lenz et al.
6,644,447 B2 11/2003 Pohl
6,932,427 B2 8/2005 Tamura

FOREIGN PATENT DOCUMENTS

DE 42 21 215 1/1994
EP 14 02 797 A 3/2004

(Continued)

*Primary Examiner*—Milton Nelson, Jr.
(74) *Attorney, Agent, or Firm*—Davis Bujold & Daniels, P.L.L.C.

(57) ABSTRACT

A case (1), such as a suitcase or trolley case, with a seat (6) is disclosed. The case has a channel (7A, 7B) provided near or along a surface (such as the rear surface 4B) of the case, and the seat is movable between a first stowed position in which the seat is held within the channel and a second seating position in which at least part of the seat lies substantially flat along the top surface (4C) of the case. The seat may be stowed within a pocket (5) along the surface of the case, with the channel being housed inside the pocket. Alternatively, the surface of the seat may also act as the case surface when the seat is in the stowed position.

16 Claims, 3 Drawing Sheets

FOREIGN PATENT DOCUMENTS

| | | |
|---|---|---|
| FR | 2 302 066 | 9/1976 |
| FR | 28 34 431 | 7/2003 |
| GB | 21 61 455 | 1/1986 |
| GB | 21 91 682 | 12/1987 |
| JP | 2000 316619 | 11/2000 |
| WO | WO94/13169 | 6/1994 |
| WO | WO98/03096 | 1/1998 |
| WO | WO99/60882 | 12/1999 |

* cited by examiner

CASE WITH SEAT

This application is a National Stage completion of PCT/GB2004/002085 filed May 14, 2004 which claims priority from British Application Serial No. 0311256.2 filed May 16, 2003.

FIELD OF INVENTION

The present invention relates to a case, such as a suit, trolley, travelling, cabin, or carry-on case. More particularly, the present invention relates to a case having a seat that allows a user to sit on the case.

BACKGROUND OF INVENTION

With the proliferation of travel routes and travel options, more people than ever before are travelling long distances. Typically, such travellers carry a suitcase (also called a trolley case or traveller's case) to hold personal items such as clothing, documents, and other sundries. While travelling there are periods during which it is desirable to sit down, e.g., at an airport or train station, but no convenient seat is available. In view of this inconvenience, various mechanisms for combining a suitcase and a seat have been proposed.

For instance, International Patent Publication Nos. WO03/099056 and WO98/03096 describe suitcases with foldable chairs that can be unfolded when a user desires to sit. Unfortunately, these foldable chairs are relatively complex and expensive to manufacture, and they are also fairly bulky and cumbersome when in use. German Patent No. DE4221215 more simply proposes to affix a seat having a smooth sitting surface onto the top surface of a suitcase. The seat is formed from a separate moulded part that is riveted and/or screwed to the suitcase. However, the seat in DE4221215 is likely to undesirably detract from the aesthetic look, quality and design of the suit case, and it may further impair the suitcase's ability to fit into constrained spaces like luggage racks and/or to comply with carry-on luggage size restriction guides.

In a similar vein, solutions for altering a suitcase to act as a tram or stroller for a child have also been proposed. For example, International Patent Publication No. WO99/60882 discloses a travel case mounted on a collapsible trolley that includes a seat for seating an infant. The seat may include a vertical wall support of flexible sheet material for supporting the infant, the support having a pair of openings through which the legs of the infant can pass. This seat support is suspended from an inverted U-shaped safety bar. A backrest of stiff, apertured sheet material is fixed to and extends between two longitudinal members that are slidably displaceable (via a handle) along the back of the case. In a first embodiment of WO99/60882, no separate seat rest or platform other than the case's top surface is provided to support the rear end of the infant. This may degrade the structural reliability of the case and/or provide insufficient support, particularly if a heavier load such as an adult or larger child would occupy the seat. Furthermore, the use of a top suitcase surface as a seat may be uncomfortable for a user as that surface typically lies above parts of the suitcase frame and/or is not entirely flat.

In a second embodiment of WO99/60882, the upper surface of the case has a flat surface area permanently formed on it to provide added support for a sitting infant. However, again, such a permanently affixed seat surface may undesirably detract from the aesthetic look, quality and design of the suit case. Furthermore, as already indicated, such a permanently affixed seat surface (as well as other bulky elements, such as additional wheels, that protrude from the case) may impair the case's ability to fit into constrained spaces like luggage racks as well as the case's ability to comply with carry-on luggage size restriction guides.

European Published Patent Application No. EP1402797A discloses a wheeled suitcase with a fold-away seat (suitable for receiving a small child) placed in a fixed or removable manner on the top surface of the suitcase. The telescopic shaft or shafts of the suitcase can provide a means of support for the back of the child or, alternatively, a handle for the child to hold on to. The seat comprises a seat base part that rests on the top wall of the suitcase and at least one backrest part that is hinged to the seat base and that can be vertically positioned for use. When the seat is in use the back rest part lies against, and may be temporarily fixed to, the telescopic shafts that can be extended from the frame of the suitcase via a retractable handle. When the seat is not in use, the back rest part is folded down and both the seat base and back rest parts remain resting on the top wall of the suitcase. Alternatively, the assembly of the seat base and back rest parts can be rotated on the hinges and placed against the lowered telescopic shafts. Again, however, the seat base and back rest parts in EP1402797A undesirably detract from the aesthetic features and also significantly impair the case's ability to fit into constrained or restricted spaces.

Consequently, there is clearly a need for a suitcase with a seat that can provide sufficient support for an adult while not significantly detracting from the compactness or the aesthetic appearance of the suitcase when the seat is not in use.

BRIEF SUMMARY OF INVENTION

The present invention aims to resolve these drawbacks by providing a case with a seat as set out in the appended claims.

More particularly, the invention provides a case comprising a seat connected to the case. The case has a channel provided near or along a surface of the case, and the seat is movable between a first stowed position in which the seat is held within the channel and a second seating position in which at least part of the seat lies substantially flat along the top surface of the case. The surface near or along which the seat is stowed is preferably the rear surface of the case, but may also be another surface of the case such as a side surface. In one embodiment, the seat is stowed within a pocket along the stowing surface of the case, and in this case the channel is housed inside the pocket. In an alternative embodiment, the surface of the seat also acts as the corresponding surface for the case when the seat is in the stowed position. The channel preferably comprises first and second channel guide sections, with each channel guide section having a slot formed therewithin. The seat also preferably comprises a pair of lugs at one end thereof, and the lugs are slidably engageable within the channel guide slots. The case may also further comprise a retractable handle having two vertically extendible members, each vertically extendible member having a slot formed therewithin and the lugs of the seat also being slidably and pivotably engageable within the handle member slots.

BRIEF DESCRIPTION OF THE DRAWINGS

The objects and advantages of the present invention will be better understood and more readily apparent when the following description is considered in conjunction with the accompanying drawings which illustrate, by way of example, preferred embodiments of the invention and in which.

DETAILED DESCRIPTION OF PREFERRED EMBODIMENTS

Figure 1:
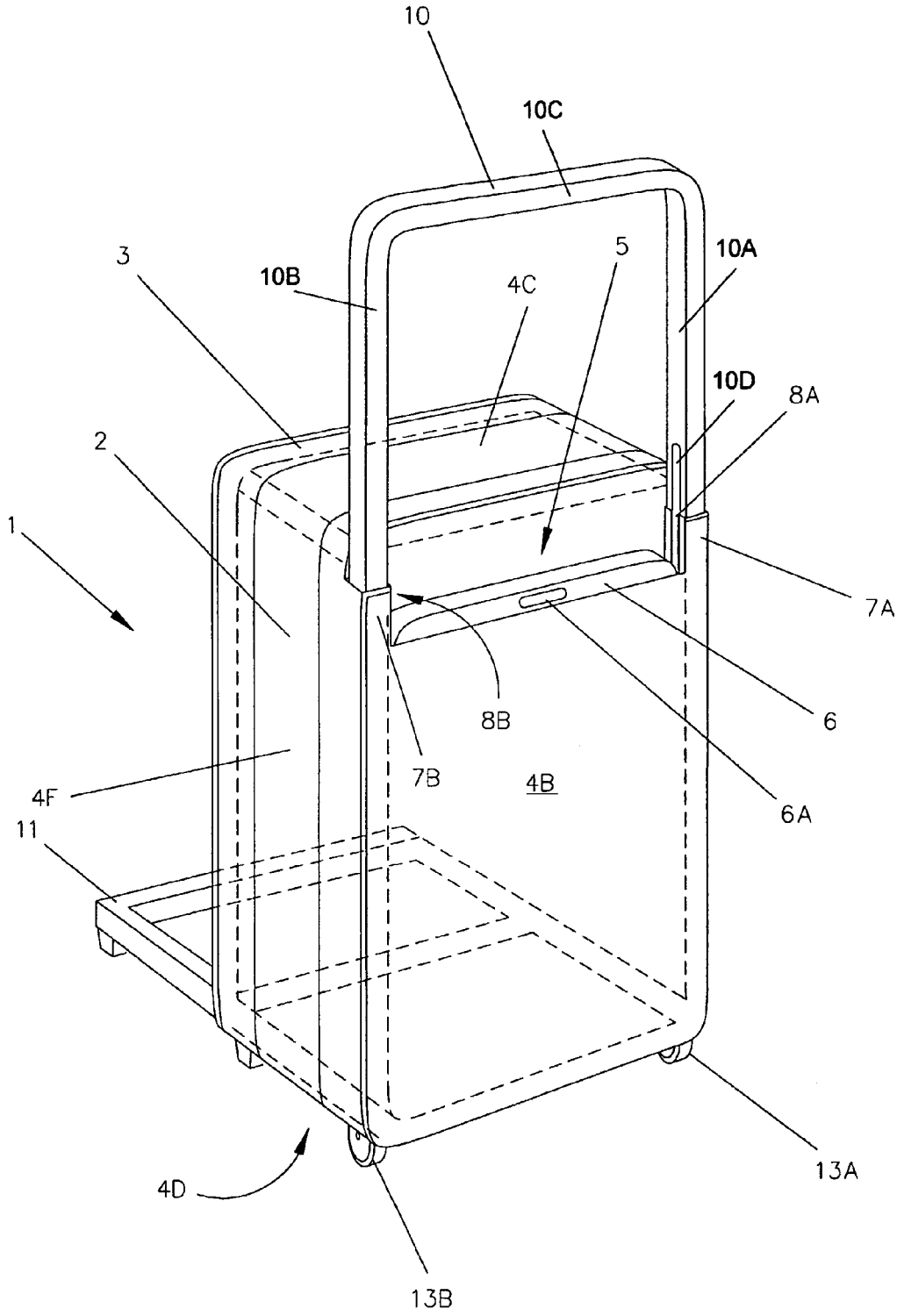
FIG. 1 is a back perspective view of a case with a seat in accordance with one embodiment of the present invention.
Figure 2:
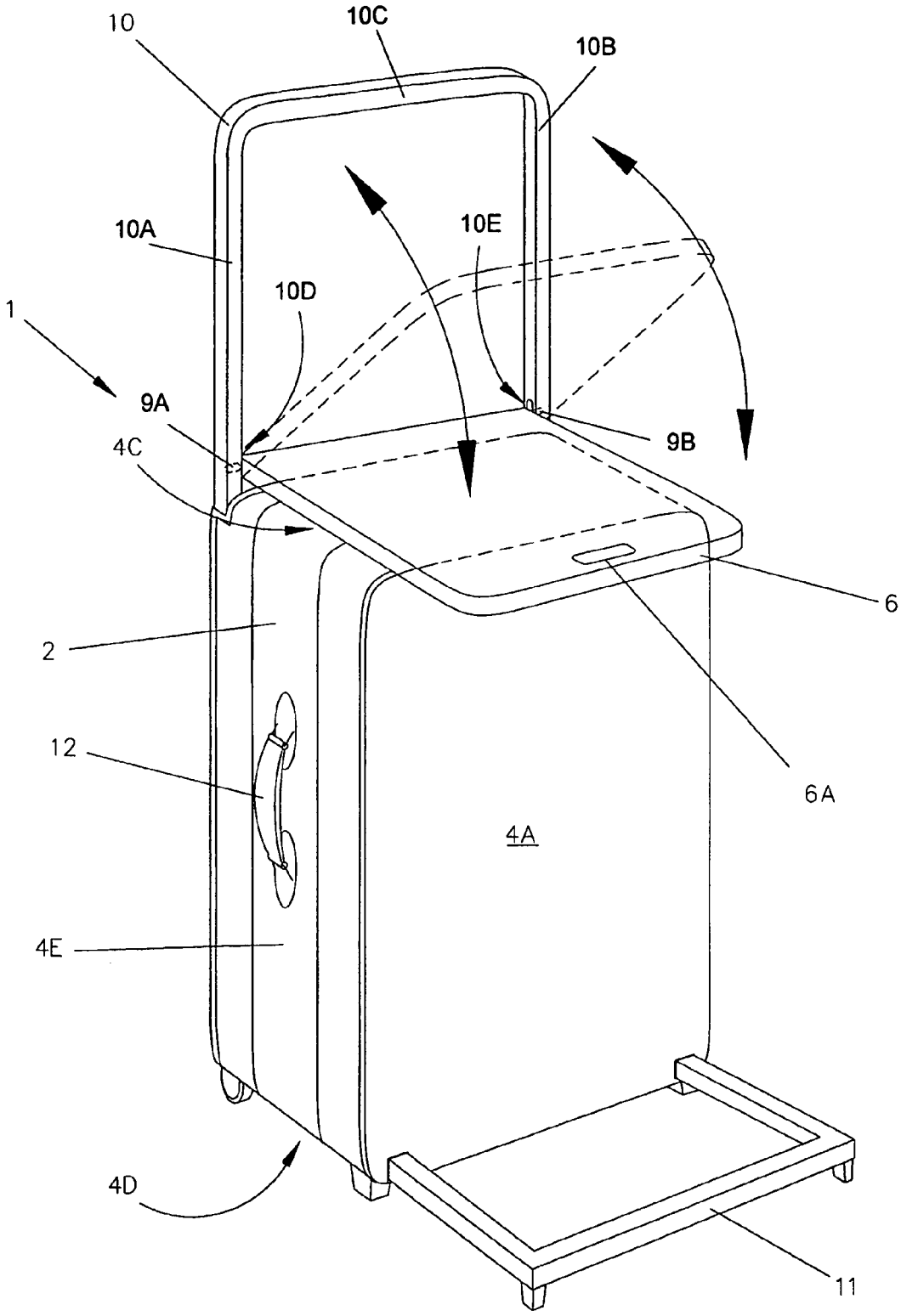
FIG. 2 is a front perspective view of the case in FIG. 1.

In accordance with an exemplary embodiment of the present invention, FIGS. 1 and 2 are back and front perspective views respectively of a case 1 with a seat 6 connected to the case. Case 1 is preferably a suitcase (the terms suitcase, trolley case, travelling case, cabin case, and carry-on case are used interchangeably herein), but it may generally comprise any other type of case such as a case for carrying shopping or other goods.

Case 1 may have a frame covered with a flexible material such as fabric or leather; however case 1 may also comprise a rigid material such as plastic or aluminium (in which case a frame may not be necessary). In the illustrated embodiment of FIGS. 1 and 2, case 1 has a body 2 defined by an internal case frame 3 that is generally in the form of a rectangular box. Case frame 3 is partly indicated in broken lines in FIG. 1. Case body 2 has a front surface 4A, a rear surface 4B, a top surface 4C, a lower surface 4D, and two side surfaces 4E and 4F. In a preferred embodiment, seat 6 is stowed in or along rear surface 4B of case 1.

In accordance with this preferred embodiment and as shown in FIG. 1, when the seat is not in use, seat 6 is stowed in a pocket 5 along rear surface 4B. In the stowed position, seat 6 is at least predominantly covered by pocket 5 and therefore the aesthetic look and design of case 1 is not significantly altered when the seat is in this position. Furthermore, since seat 6 lies along the surface 4B when stowed and since the seat has a similar (or smaller) area to that of the rear case surface, the compactness of case 1 is also not significantly affected when the seat is not in use.

When a user desires to use seat 6, the seat is withdrawn from pocket 5 and placed in a seating position (shown in solid line in FIG. 2) in which seat 6 lies substantially flat upon top surface 4C of case 1. Like a conventional firm seat base, seat 6 may be formed from plastics or from a fabric-covered metal frame. Seat 6 serves to spread the force of a sitting user over substantially the entire frame 3 of case 1, and in this manner is better able to support heavier loads than many prior art case/seat combinations—in particular those that are only suitable for supporting infants or small children. As shown, seat 6 may also have a recess 6A near one end thereof to facilitate the removal of the seat from pocket 5.

In a preferred embodiment, case 1 further includes a retractable U-shaped handle 10. U-shaped handle 10 comprises two telescoping (i.e., vertically extendible) members 10A and 10B coupled together at their top ends by a horizontal bar 10C. Members 10A and 10B and bar 10C may be formed as a single piece, as illustrated, or as separate pieces that are subsequently connected together. Horizontal bar 10C may also comprise a grip (not shown) to facilitate its manipulation by a user.

As best seen in FIG. 2, at or near the sides of rear surface 4B, case frame 3 includes a channel formed from two channel guide sections 7A and 7B each having a slot 8A and 8B (respectively) formed therein. The channel is generally housed inside of pocket 5, and seat 6 includes a pair of lugs 9A and 9B at one end that engage slidably within slots 8A and 8B while seat 6 is in pocket 5. In the illustrated embodiment, telescoping members 10A and 10B of handle 10 further include slots 10D and 10E (respectively) in which lugs 9A and 9B are also slidably and pivotably engageable. The top ends of slots 8A and 8B are open-ended and the width of slots 10D and 10E is similar to that of slots 8A and 8B. In this manner, as seat 6 is stowed in pocket 5, lugs 9A and 9B slide down slots 8A/10D and 8B/10E until they reach a bottom end (not shown) of one or both pairs of those slots. At this point, seat 6 reaches the fully stowed position. As seat 6 is pulled into the seating position, lugs 9A and 9B are slid up slots 8A/10D and 8B/10E eventually leaving slots 8A and 8B as shown in FIG. 2. Thus, in this embodiment, when seat 6 has been removed from pocket 5 and is in or near its seating position, lugs 9A and 9B are held only in slots 10D and 10E and seat 6 can then be pivoted so that it lies substantially flat upon top surface 4C.

Case 1, seat 6, and the length of slots 8A, 8B and/or 10D, 10E are preferably dimensioned so that seat 6 is fully covered by pocket 5 when in the stowed position. Furthermore, the length of slots 10D and 10E may be dimensioned so that when handle 10 is partly or fully extended, the bottom ends of slots 10D and 10E are brought into contact with lugs 9A and 9B to partially lift seat 6 so that the end of seat 6 with recess 6A protrudes from pocket 5. In this manner, by extending handle 10, recess 6A becomes more easily accessible to a user. Conversely, when handle 10 is returned to its fully retracted position, the top ends of slots 10D and 10E may serve to force lugs 9A and 9B downward, returning seat 6 to the fully stowed position.

Figure 3:
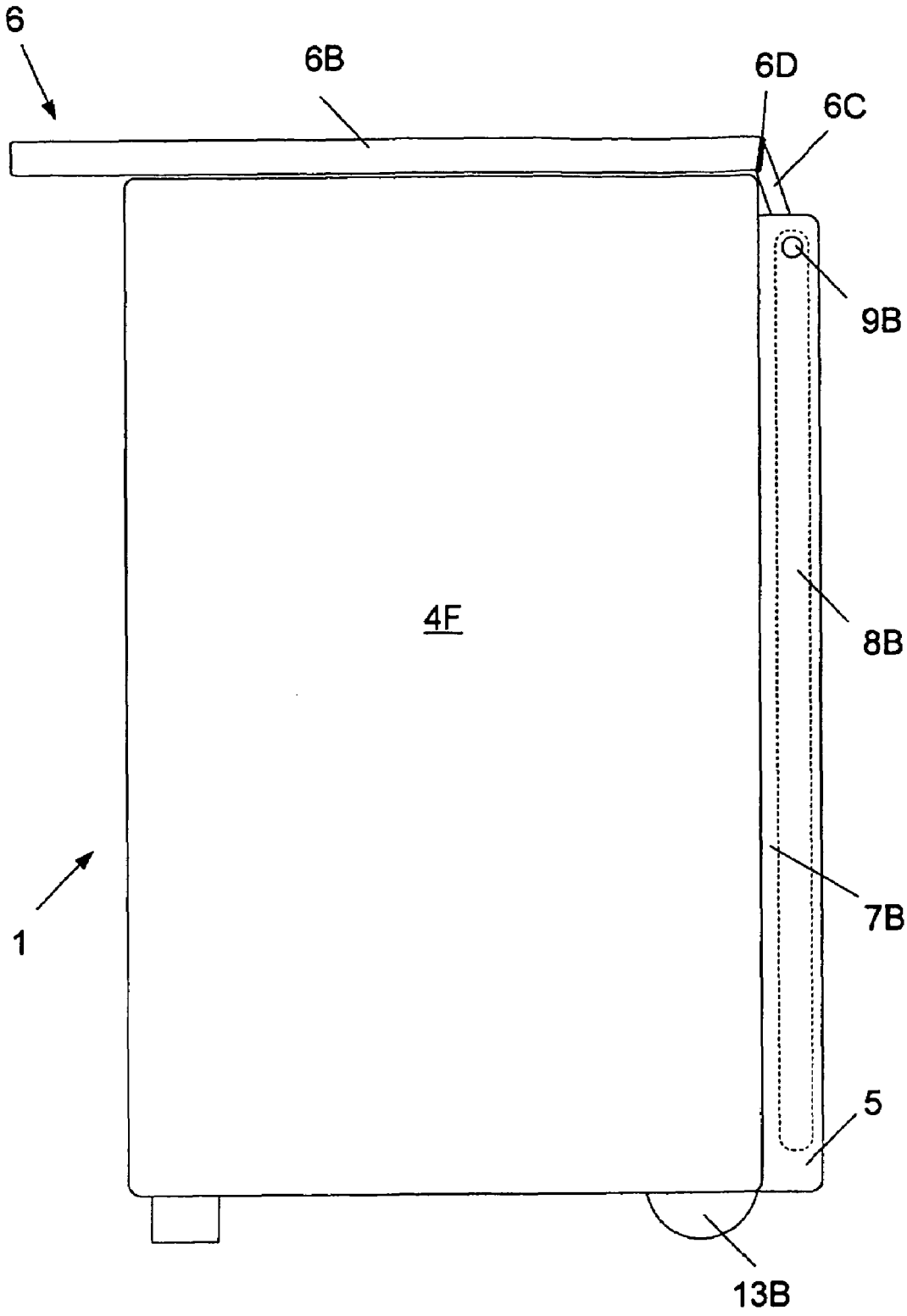
FIG. 3 is a side view of a case with a seat in accordance with another embodiment of the present invention.

In another embodiment, illustrated in the side view of FIG. 3, seat 6 moves only within slots 8A and 8B (in channel guides 7A and 7B), and slots 8A and 8B are closed at both their top and bottom ends. The retractable handle 10 (not shown in FIG. 3) is independent of the mechanism for moving seat 6 between the seating and stowed positions, and therefore handle 10 can be dispensed with in this embodiment. Referring to FIG. 3, seat 6 comprises a main seat portion 6B and a base seat portion 6C pivotably connected to one another at 6D by a hinge or the like. This enables main seat portion 6B to lie substantially flat on top surface 4C of case 1 even though lug 9B can only climb to a lower height at the top of slot 8B within channel guide 7B. In this embodiment, to ensure ready access to seat 6, recess 6A (not shown in FIG. 3) preferably protrudes slightly from pocket 5 even when seat 6 is in the fully stowed position.

Referring back to FIGS. 1 and 2, case frame 3 may optionally include a retractable ground support member 11 that extends from the bottom end of front surface 4A when in use and retracts into a recess within case 1 when not. When extracted from frame 3, support member 11 helps to further stabilise case 1, preventing the case from toppling over when a person sits on seat 6. A mechanical linkage (not shown) may be provided to extract support member 11 automatically when seat 6 is placed in the seating position. Additionally or alternatively, a retractable ground support member (not shown) that extends from the bottom end of rear surface 4B may also be used for added stability.

Like a conventional suitcase, case 1 may further include a carrying handle 12 and wheels 13A and 13B, as shown. Wheels 13A and 13B may lock when seat 6 is in the seating position and/or when a significant load is placed on seat 6.

In an alternative embodiment (not shown), no pocket 5 is provided, and instead the surface of seat 6 comprises all or part of the rear surface 4B of case 1. In this case, rear surface 4B is slidable along a channel (similar to the one formed by channel guides 7A and 7B above) so that all or part of rear surface 4B can be slid upward and then pivoted forward to lie substantially flat on the top surface 4C of the case. This embodiment may be particularly suitable for cases made of a rigid material. The internal surface of case 1 that is exposed at the back of the case (when the rear surface 4B is moved into the seating position) may comprise a flexible or a rigid material, although preferably the appearance of this internal surface is the same as or similar to that of rear surface 4B.

While the invention has been described in conjunction with specific embodiments, it is evident that numerous alternatives, modifications, and variations will be apparent to those skilled in the art in light of the foregoing description. For example, seat 6 could be stowed along (or could comprise) other surfaces of the case such as front surface 4A or side surfaces 4E or 4F.

The invention claimed is:

1. A case comprising a seat connected to the case, wherein the case has a channel provided near or along a surface of the case, and the seat is movable between a first stowed position in which the seat is held within the channel and a second seating position in which at least part of the seat lies substantially flat along a top surface of the case, wherein the seat is stowed within a pocket along said surface of the case, the channel being housed inside the pocket, the channel comprises first and second channel guide sections, each channel guide section having a slot formed therewithin, the seat comprises a pair of lugs at one end thereof, and the lugs being slidably engageable within said channel guide slots, the case further comprises a retractable handle having two vertically extendible members, each vertically extendible member having a slot formed therewithin, and the lugs also being slidably and pivotably engageable within said handle member slots.

2. The case of claim 1 wherein the surface near or along which the seat is stowed is a rear surface of the case.

3. The case of claim 1 wherein the surface near or along which the seat is stowed is a side surface of the case.

4. The case of claim 1 wherein the seat comprises a recess at one end thereof for facilitating movement of the seat from the stowed position to the seating position.

5. The case of claim 1 wherein a surface of the seat also acts as said surface of the case when the seat is in the stowed position.

6. The case of claim 1 further comprising a retractable ground support member that is extendable from near the bottom of the case when the seat is in the seating position.

7. The case of claim 1 wherein the case, the seat, and at least one of the channel guide slots and the handle member slots are dimensioned so that the seat is fully covered by the pocket when the seat is in the stowed position.

8. The case of claim 7 wherein the handle member slots are dimensioned so that when the handle is at least partially extended from the case, the bottom ends of the handle member slots are brought into contact with the lugs to partially lift the seat out of the pocket.

9. The case of claim 7 wherein the handle member slots are dimensioned so that when the handle is fully retracted within the case the top ends of the handle member slots are bought into contact with the lugs to fully return the seat to the stowed position if the seat is not already in said position.

10. A case comprising a seat connected to the case, wherein the case has a channel provided near or along a surface of the case, and the seat is movable between a first stowed position in which the seat is held within the channel and a second seating position in which at least part of the seat lies substantially flat along a top surface of the case, wherein the seat is stowed within a pocket along said surface of the case, the channel being housed within the pocket, wherein the channel comprises first and second channel guide sections, each channel guide section having a slot formed therewithin, the seat comprising a pair of lugs at one end thereof, and the lugs being slidably engageable within said channel guide slots, wherein the seat comprises a main seat portion and a base seat portion pivotably connected to the main seat portion, wherein the base seat portion comprises the lugs and the lugs are pivotably engageable within said channel guide slots, and wherein only the main seat portion lies substantially flat along the top surface of the case when the seat is in the seating position.

11. A case comprising a seat connected to the case, characterized in that the case has a channel provided near or along a surface of the case, and the seat is movable between a first stowed position in which the seat is held within the channel and a second seating position in which at least part of the seat lies substantially flat along a top surface of the case, wherein a surface of the seat also acts as said surface of the case when the seat is in the stowed position, the channel comprises first and second channel guide sections, each channel guide section having a slot formed therewithin, the seat comprises a pair of lugs at one end thereof, and the lugs are slidably and pivotably engageable within said channel guide slots, wherein, when the seat is in the seating position, an internal surface of the case behind said surface is exposed, and wherein the appearance of the exposed internal surface is the same as or similar to that of the seat.

12. The case of claim 11 wherein the seat is stowed within a pocket along said surface of the case, the channel being housed inside the pocket.

13. A case comprising a container body end a seat for deployment from a stowed position on a rear face of the container body into a deployed position onto a top surface of the container body when the case is standing upright, wherein the seat comprises a firm seat base of substantially flat form, and the case further comprises a guide-channel for retaining the seat base in its stowed position, the guide-channel extending along the rear face of the container body to retain the seat base face-to-face with the rear face of the container body in the stowed position, the seat base being engaged in the guide-channel for sliding movement along the guide-channel from the stowed position in a direction towards the top surface of the container body, and pivot means for pivotal movement of the seat base onto the top surface of the container body to extend substantially fiat on the top surface of the container body in the deployed position, and wherein the case has a telescopically-extendable handle for maneuvering the case, the handle being selectively extendable telescopically from a retracted position on the rear face of the container body to an extended position in which the handle projects from the rear face beyond the top surface of the container body.

14. The case of claim 13 wherein the guide-channel comprises first and second channel guide sections, each channel guide section having a channel guide slot formed therewithin, the seat further comprises a pair of lugs at one end of the seat base, and the lugs are slidably and pivotably engageable within said channel guide slots.

15. The case of claim 13 including a packet for housing the seat base when the seat base is in the stowed position.

16. The case of claim 13 wherein the guide-channel comprises two elongate guide-sections that extend parallel to one another, and the seat base is engaged with the guide-sections for sliding movement along them.

* * * * *